US010051970B1

(12) United States Patent
Kramer et al.

(10) Patent No.: US 10,051,970 B1
(45) Date of Patent: Aug. 21, 2018

(54) ADJUSTABLE SUPPORT LEGS FOR A MATTRESS FOUNDATION

(71) Applicant: Dreamwell, Ltd., Atlanta, GA (US)

(72) Inventors: Kenneth L. Kramer, Greensburg, IN (US); Jeffrey M. Woodall, Greenfield, IN (US); Francis Jan, Atlanta, GA (US); Brian Wiggins, Atlanta, GA (US)

(73) Assignee: DREAMWELL, LTD., Atlanta, GA (US)

( * ) Notice: Subject to any disclaimer, the term of this patent is extended or adjusted under 35 U.S.C. 154(b) by 0 days.

(21) Appl. No.: 15/709,913

(22) Filed: Sep. 20, 2017

(51) Int. Cl.

| | |
|---|---|
| ***A61G 7/012*** | (2006.01) |
| ***A61G 13/06*** | (2006.01) |
| ***A47C 20/08*** | (2006.01) |
| ***A47C 19/04*** | (2006.01) |
| ***A47C 20/04*** | (2006.01) |

(52) U.S. Cl.
CPC ..... *A47C 20/08* (2013.01); *A47C 19/045* (2013.01); *A47C 20/041* (2013.01); *A61G 7/012* (2013.01); *A61G 13/06* (2013.01)

(58) Field of Classification Search
CPC ..... A61G 7/002; A61G 7/012; A61G 7/015; A61G 7/018; A61G 13/02; A61G 13/06; A61G 13/08
USPC ..... 5/611, 600, 11
See application file for complete search history.

(56) References Cited

U.S. PATENT DOCUMENTS

| | | | | |
|---|---|---|---|---|
| 2,339,075 A * | 1/1944 | Hollnagel | A61G 7/012 | 5/611 |
| 2,429,865 A * | 10/1947 | Bresch | A61G 7/1019 | 5/86.1 |
| 2,522,759 A * | 9/1950 | Lindquist | A61G 7/005 | 5/610 |
| 2,540,133 A * | 2/1951 | Miller | A61G 7/002 | 5/614 |
| 2,592,166 A * | 4/1952 | McLean | A61G 7/012 | 280/43.21 |
| 2,604,639 A * | 7/1952 | Killifer | A61G 7/012 | 5/611 |
| 2,681,454 A * | 6/1954 | Tallman | A61G 7/012 | 254/7 R |

(Continued)

FOREIGN PATENT DOCUMENTS

FR 2547185 A1 * 12/1984 ..... A47C 19/021

*Primary Examiner* — Robert G Santos
(74) *Attorney, Agent, or Firm* — Cantor Colburn LLP

(57) ABSTRACT

Height adjustable mattress assemblies generally include a foundation frame including side frame members and transverse frame members attached at respective ends by a corner bracket to define a generally rectangular shape. A deck is supported by the foundation frame and adjustable support legs are coupled to each one of the corner brackets. Each of the adjustable support legs includes an outer tubular member fastened to an interior facing portion of the corner bracket and a differential driven linear actuator including an extendible portion. The assemblies further include a single or dual actuator assembly mechanically engaged with the differential driven linear actuators in each one of the adjustable support legs to extend or retract the extendible portion so as to change an elevation of the foundation frame relative to ground upon actuation thereof. Also disclosed are processes for adjusting a height of a mattress assembly.

13 Claims, 13 Drawing Sheets

(56) References Cited

U.S. PATENT DOCUMENTS 2,802,219 A * 8/1957 Travis ..... A47C 20/041 5/611
2,807,808 A * 10/1957 Wetzler ..... A61G 7/012 5/11
2,827,641 A * 3/1958 Reichert ..... A61G 7/012 5/11
2,830,303 A * 4/1958 Sandock ..... A61G 7/008 108/147
2,870,460 A * 1/1959 Sanford ..... A61G 7/012 5/11
2,872,688 A * 2/1959 Reichert ..... A61G 7/012 5/611
2,913,300 A * 11/1959 Darnell ..... A61G 7/002 477/8
3,012,253 A * 12/1961 Reichert ..... A61G 7/002 5/611
3,039,118 A * 6/1962 Hutt ..... A61G 7/012 5/11
3,105,246 A * 10/1963 Emrick ..... A61G 7/012 108/147
3,132,351 A * 5/1964 Huntress et al. ..... A61G 7/002 5/611
3,174,161 A * 3/1965 Black ..... A61G 7/002 5/616
3,281,873 A * 11/1966 Stanley et al. ..... A61G 7/002 192/32
3,587,482 A * 6/1971 Wieland ..... A47B 9/00 108/147
3,640,520 A * 2/1972 Wieland ..... A61G 13/009 269/61
3,797,052 A * 3/1974 Licina ..... A61G 7/005 5/607
4,057,240 A * 11/1977 Damico ..... A61G 13/0018 5/611
4,435,861 A * 3/1984 Lindley ..... A61G 7/0005 5/613
4,545,084 A * 10/1985 Peterson ..... A61G 7/018 403/197
5,095,560 A * 3/1992 Volker ..... A61G 7/012 5/11
5,544,375 A * 8/1996 Urness ..... A47C 20/041 5/611
5,685,035 A * 11/1997 Urness ..... A47C 20/041 5/611
5,870,784 A 2/1999 Elliott
6,006,379 A 12/1999 Hensley
6,393,641 B1 5/2002 Hensley
6,499,156 B1 * 12/2002 Dirst ..... A61G 7/1019 5/600
7,036,166 B2 5/2006 Kramer et al.
7,930,780 B2 4/2011 Clenet
8,418,290 B2 4/2013 Shih
8,640,285 B2 2/2014 Heimbrock et al.
8,806,682 B2 8/2014 Hornbach et al.
9,049,942 B2 6/2015 Huang
2014/0075674 A1 3/2014 Chun et al.
2016/0262548 A1 9/2016 Broom et al.

* cited by examiner

ADJUSTABLE SUPPORT LEGS FOR A MATTRESS FOUNDATION

BACKGROUND

The present disclosure generally relates to mattress assemblies, and more particularly, to adjustable support legs for foundations for mattress assemblies.

Foundations for mattress assemblies are used in the healthcare field and in residential applications. A typical foundation includes a base and a mattress frame or support, which can be divided into a head and back section, an intermediate seat section, and a leg and foot section. Some foundations include adjustable sections, also referred to as articulating mattress assemblies, wherein the various mattress frame sections are pivotally interconnected and have a continuous range of adjustment. The sections are generally moveable from a flat, user resting position to a seated position with the legs bent or the legs straight and the occupant's back angled upwardly with respect to the seat section. The sections are pivoted by motor drives, hand operated cranks or through the user's weight. Other foundations are generally static. That is, the various frame sections are not pivotally interconnected and are typically of a one piece construction providing a fixed horizontal and planar surface. The foundation itself, whether it is for an adjustable foundation or for a static foundation, is typically elevated at a fixed height relative to ground by support legs.

BRIEF SUMMARY

Disclosed herein are mattress assemblies and processes for adjusting a height of a foundation frame upon which a mattress is disposed. In one or more embodiments, a mattress assembly includes a foundation frame including side frame members and transverse frame members attached at respective ends by a corner bracket to define a generally rectangular shape; a deck supported by the foundation frame, the deck including a head and back section, an intermediate seat section, and a leg and foot section; adjustable support legs coupled to each one of the corner brackets, wherein each of the adjustable support legs includes an outer tubular member fastened to an interior facing portion of the corner bracket and a differential driven linear actuator including an extendible portion configured to retract or extend relative to the outer tubular member so as to change an elevation of the foundation frame relative to ground upon actuation thereof; and a single rotary actuator assembly mechanically engaged with the differential driven linear actuators in each one of the adjustable support legs to simultaneously and selectively extend or retract the extendible portion.

In one or more embodiments, a mattress assembly includes a foundation frame including side frame members and transverse frame members attached at respective ends by a corner bracket to define a generally rectangular shape; a deck supported by the foundation frame, the deck including a head and back section, an intermediate seat section, and a leg and foot section; adjustable support legs coupled to each one of the corner brackets, wherein each of the adjustable support legs includes an outer tubular member fastened to an interior facing portion of the corner bracket and a differential driven linear actuator comprising an extendible portion configured to retract and extend relative to the outer tubular member to change the elevation of the foundation frame relative to ground upon actuation thereof; and two rotary actuator assemblies mechanically engaged with the differential driven linear actuators of an adjacent pair of the adjustable support legs to simultaneously and selectively extend or retract the extendible portion.

A process for adjusting a height of a mattress assembly includes providing a mattress on a foundation frame comprising side frame members and transverse frame members attached at respective ends by a corner bracket to define a generally rectangular shape; a deck supported by the foundation frame, the deck including a head and back section, an intermediate seat section, and a leg and foot section; and adjustable support legs coupled to each one of the corner brackets and configured to selectively change an elevation of the foundation frame relative to ground; and lowering or raising an adjacent pair or all of the adjustable support legs to adjust the height of the mattress relative to ground.

The disclosure may be understood more readily by reference to the following detailed description of the various features of the disclosure and the examples included therein.

BRIEF DESCRIPTION OF THE SEVERAL VIEWS OF THE DRAWINGS

Referring now to the figures wherein the like elements are numbered alike.

DETAILED DESCRIPTION

Figure 1:
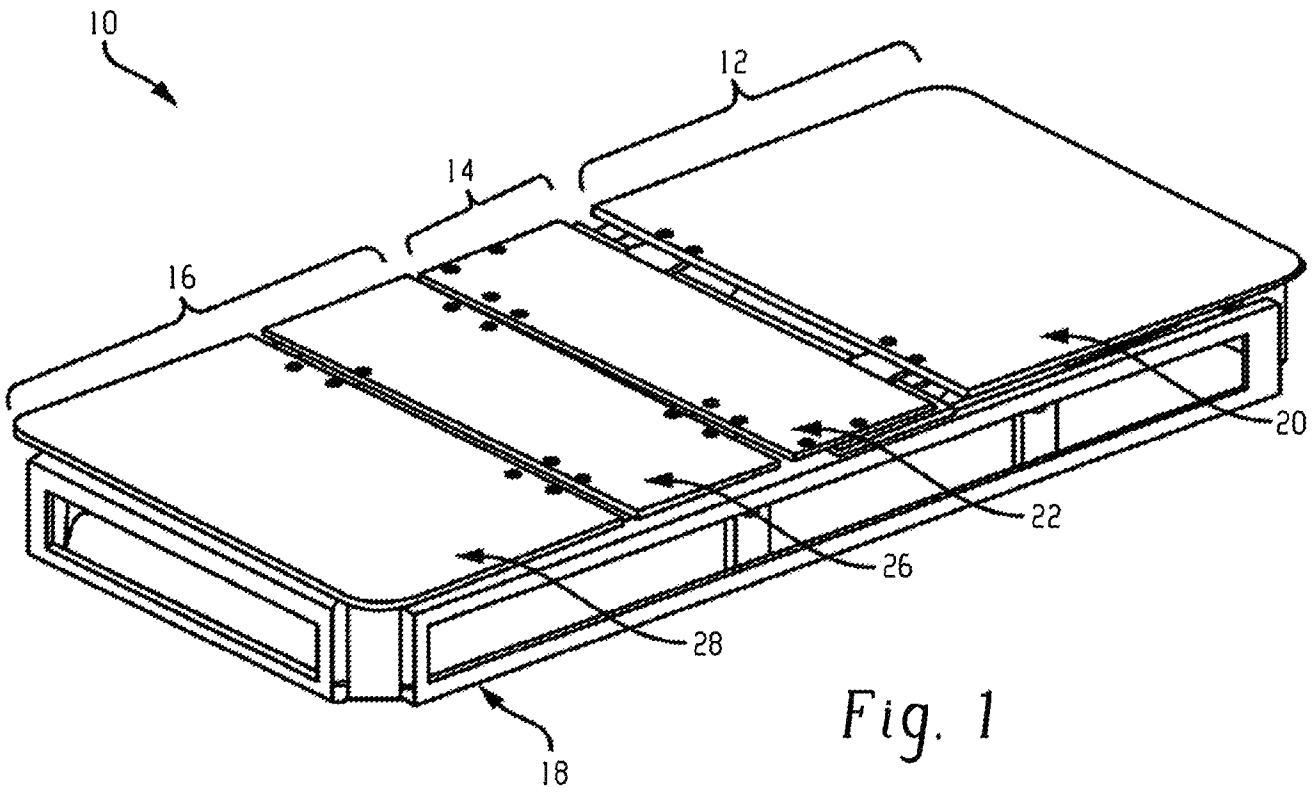
FIG. 1 is a perspective view of an exemplary adjustable mattress foundation shown in a horizontal position in accordance with the present disclosure.
Figure 2:
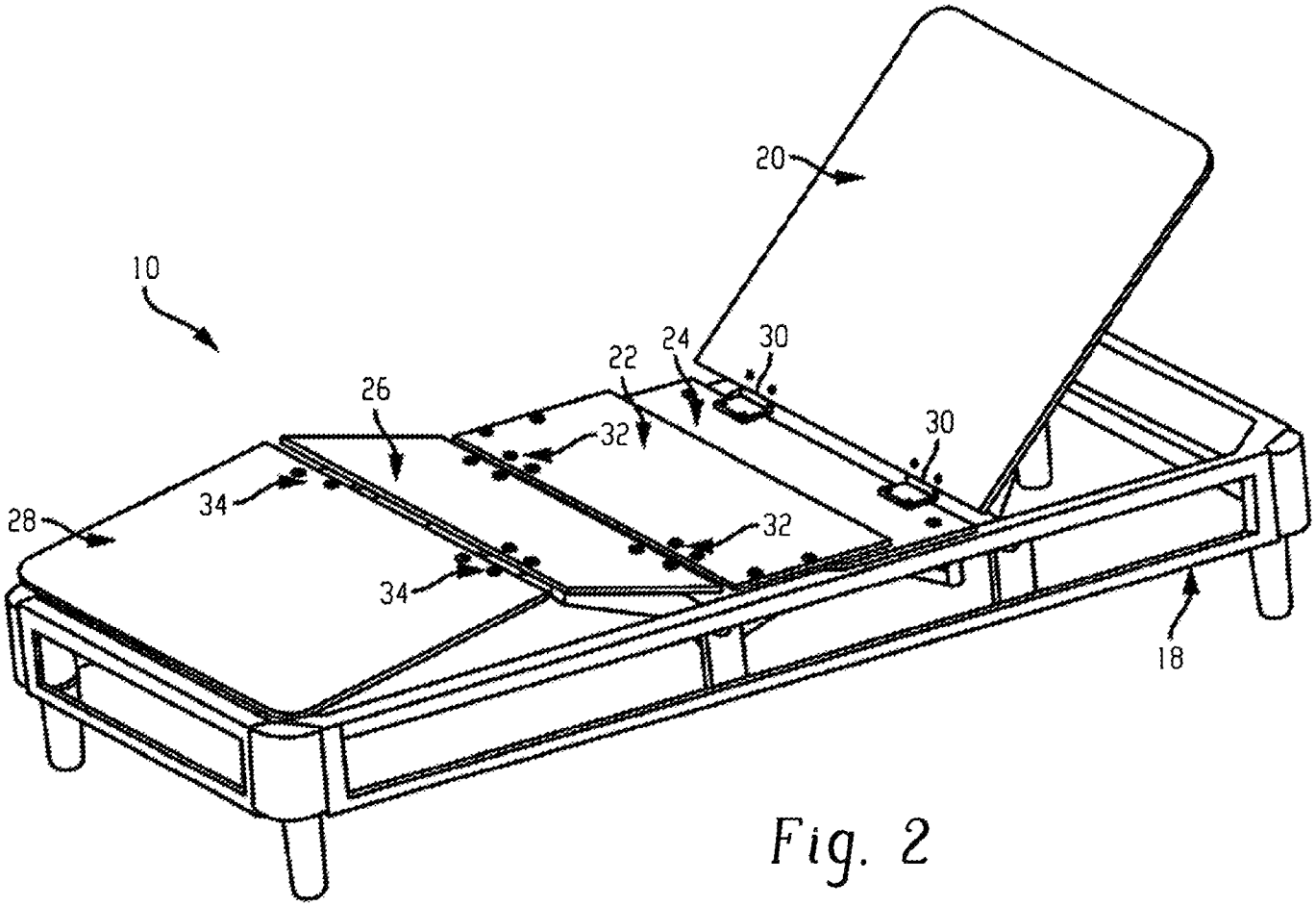
FIG. 2 is a perspective view of an exemplary adjustable mattress foundation shown in an inclined position in accordance with the present disclosure.

Referring now to FIGS. 1-2, there are shown perspective views of an exemplary adjustable mattress foundation 10 in accordance with the present disclosure. The adjustable foundation 10 includes adjustable support legs as will be described below for varying a height of the foundation relative to ground. Each adjustable support leg can be independently adjusted or two or more can be simultaneously adjusted. While reference herein is made to an adjustable foundation, it should be apparent that the adjustable support legs can be suitably utilized in static foundations, which are commonly used in residential applications, wherein the head, torso and foot sections are not incline-adjustable, are typically formed of a unitary member spanning the length and width of the foundation, and are configured to provide a stationary and horizontal mattress support surface for a generally planar mattress assembly thereon.

As is typical for adjustable mattress foundations, the adjustable mattress foundation 10 is movable between a fully horizontal position as shown in FIG. 1 and an inclined position as shown in FIG. 2. The different positions are typically defined by a head and back section 12, a leg and foot section 16, and an intermediate seat section 14 therebetween, wherein the head and back section 12 and the leg and foot section 16 can articulate, i.e., elevate, relative to the intermediate seat section 14. The different sections, 12, 14, and 16 collectively form a mattress support surface upon which a mattress (not shown) is disposed. In the illustrated inclined position shown in FIG. 2, which is exemplary and not intended to be limiting, the head and back section 12 and the leg and foot section 16 are shown elevated relative to the intermediate seat section 14. An operator or user may lie prone on a mattress disposed on the adjustable mattress foundation 10 in its fully horizontal position, in the fully inclined position, or in any position therebetween. The adjustable mattress foundation 10 generally includes a rectangular shaped foundation frame 18, which supports and elevates the head and back section 12 and the leg and foot section 16, and the intermediate seat section 14, relative to ground.

The head and back section 12 can be formed of a single panel 20 whereas the intermediate seat section 14 as well as the leg and foot section 16 can be formed of two panels 22, 24 and 26, 28, respectively, as shown more clearly in FIG. 2. Panel 20 of the head section 12 is hingedly connected via hinges 30 to lower panel 24 of the intermediate seat section 14 at one end thereof. Likewise, the leg and foot section 16 includes panel 26 hingedly connected at one end via hinges 32 to panel 22 of the intermediate seat section 14 and at another end to panel 26 of the leg and foot section 16 via hinges 34, wherein panels 22, 24 of the intermediate seat section 14 are in a sliding relationship to selectively increase or decrease length of the intermediate section upon inclination or declination of the head section 12 and/or the leg and foot section 16. In the intermediate section 14, panel 22 is an upper panel and panel 24 is the lower panel. Additionally, panels 26 and 28 of the leg and foot section 18 are hingedly connected to one another via hinges 34.

The different sections 12, 14, and 16 are supported on a generally rectangular foundation frame 18, which includes a linkage assembly (not shown) operable to selectively articulate the sections 12 and 16 relative to section 14 of the mattress support surface. The linkage assembly is not intended to be limited. An exemplary linkage assembly and adjustable foundation is described in U.S. Pat. No. 5,870,784, incorporated herein by reference in its entirety.

Figure 3:
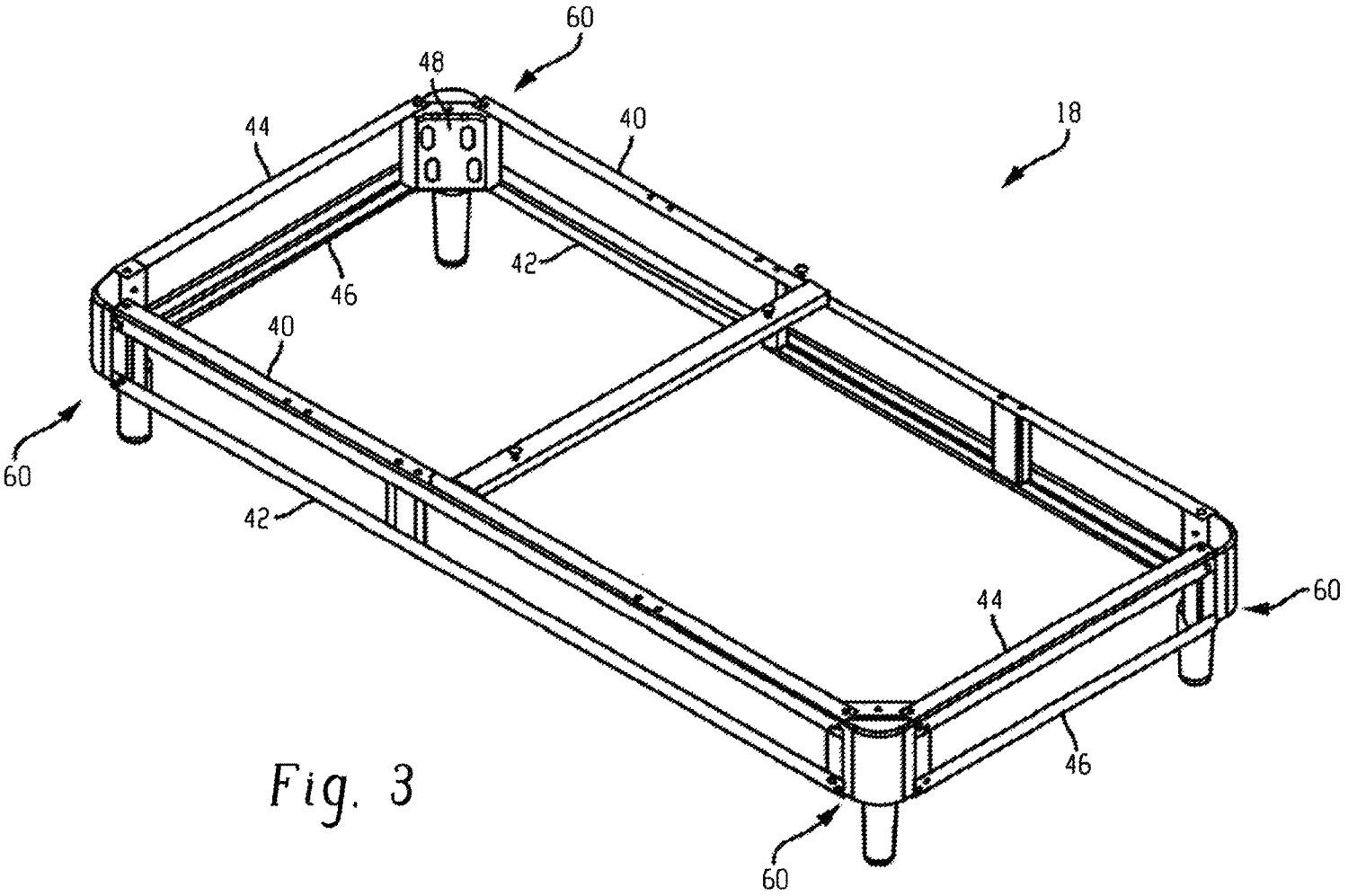
FIG. 3 is an isometric view of an adjustable foundation frame in accordance with the present disclosure.

As shown more clearly in FIG. 3, the generally rectangular foundation frame 18 generally includes upper and lower side frame members 40, 42 respectively, and upper and lower transverse frame members 44, 46, respectively. Respective ends of the upper and lower side frame members 40, 42 and the upper and lower transverse frame members 44, 46 are coupled to a corner bracket 48 to define the generally rectangular shape of the foundation frame 18. Adjustable support legs 60 (shown in FIG. 3) are coupled to the corner brackets 48 at each corner of the foundation for elevating the foundation 18 relative to ground.

Figure 4:
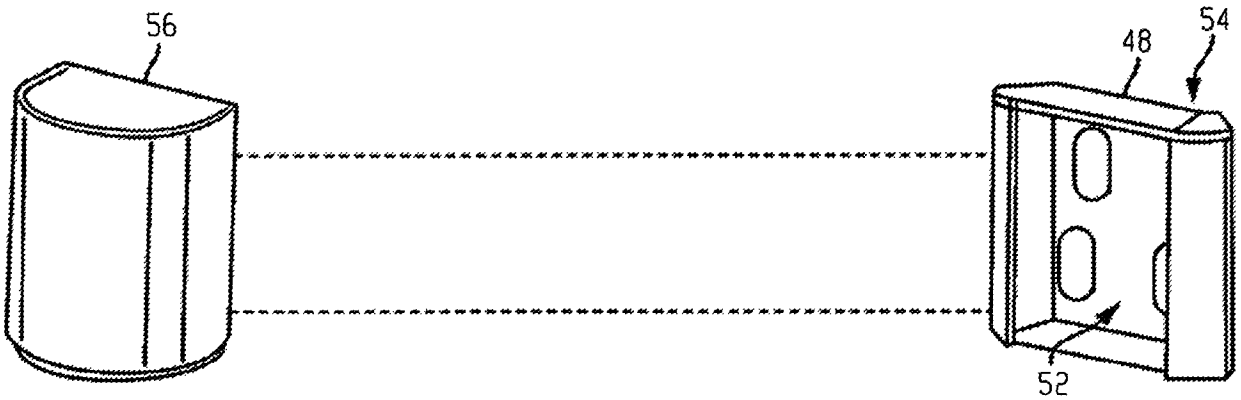
FIG. 4 is an exploded perspective view of a foam block and corner bracket arrangement in accordance with the present disclosure.

As shown in FIG. 4, the corner bracket 48 includes an exterior facing portion 52 and an interior facing portion 54. End surfaces are configured for mechanical attachment of the respective ends of the upper and lower side frame members 40, 42 and the upper and lower transverse frame members 44, 46 so as to define a 90 degree relationship between the transverse frame members and the side frame members.

The exterior facing portion 52 is configured to receive an arcuate shaped foam block 56.

Figure 5:
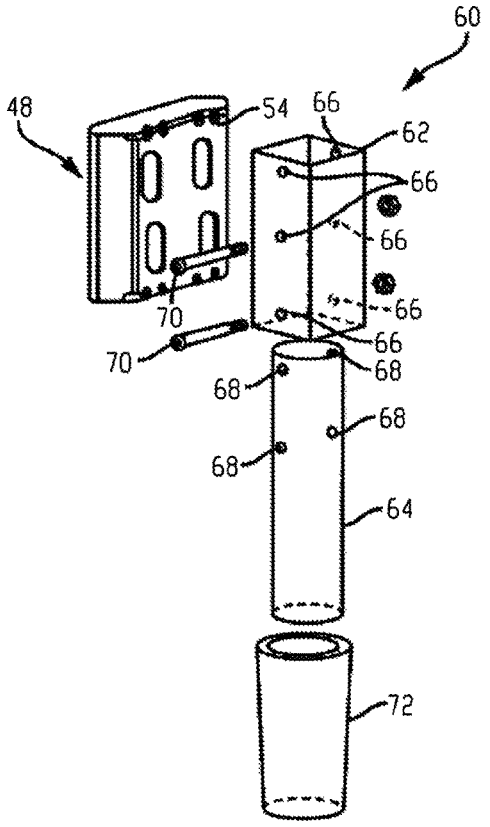
FIG. 5 is an exploded perspective view of a manually adjustable support leg in accordance with the present disclosure.

As shown in FIG. 5, the adjustable support leg 60 includes an outer tubular member 62 coupled to the interior facing portion 54 of the corner bracket 48. The outer tubular member 62 can be welded thereto or mechanically fastened. The tubular outer member 62 is shown having a square cross sectional shape, however, the tubular outer member can have a geometric cross section of any shape. The adjustable support legs 60 can be manually or automatically adjusted to provide different clearance heights.

For manual adjustment, each support leg 60 includes an inner tubular member 64 slidably engageable within the outer tubular member 62, wherein the cross sectional shape can vary from that of the outer tubular member 62 so long as the inner tubular member can be moved vertically with respect to the outer tubular member and lateral movement of the inner tubular member is substantially prevented. That is, the inner tubular member 64 is dimensioned to provide a close sliding fit within the outer tubular member 62.

A selected one of the inner and outer tubular members 62, 64. respectively, includes a plurality of linearly spaced apertures that generally correspond to a defined clearance height. The other one 62 or 64 can include at least one aperture, wherein a selected one of the plurality of linearly spaced apertures can be aligned with the at least one aperture so that a pin can be slidably engaged therewith so as to lock support legs 60 at a desired clearance height for the foundation 18. In FIG. 5, the outer tubular member 62 is configured with three linearly arranged and spaced apart apertures 66. The inner tubular member 64 is configured with two linearly arranged and spaced apart apertures 68, wherein a distance between the two linearly arranged and spaced apart apertures is equal to a distance between adjacent ones of the three linearly arranged and spaced apart apertures of the outer tubular member 62. When the respective apertures 66, 68 are aligned upon insertion of the inner tubular member 64 into the outer tubular member 62, a pin 70 can be inserted into the two aligned apertures 66, 68 to define a clearance height for the foundation 18 relative to ground.

In one or more embodiments, the pin 70 can be inserted through the outer tubular member 62. In these embodiments, a complementary plurality of apertures coaxially aligned with apertures 66, 68 are provided in a distal wall of the inner and outer tubular members. The manually adjustable support leg 60 may further include a decorative outer cover 72 as shown, which can be attached to the inner tubular member 64. Optionally, a caster can be attached to a bottom surface of the support leg.

In one or more other embodiments, the pin can be a depressible detent pin to maintain the selected clearance height. In this embodiment, the linearly and vertically spaced apertures are provided in the inner and outer tubular members as previously described. A channel can extend between each linear and vertical aperture of the outer tubular member and has a width less than the diameter of the pin. The inner tubular member includes the depressible detent pin, which further includes a leaf spring attached thereto that continuously urges detent pin in an outwardly direction so that when the inner tubular member is at a predefined height, the detent pin extends outwardly through the selected aperture of the outer tubular member so as to provide a locking relationship between the inner and outer tubular members. When the operator desires a different height, the detent pin can be depressed to slideably move the inner tubular member so as to engage a different selected aperture corresponding to a different clearance height.

Figure 6:
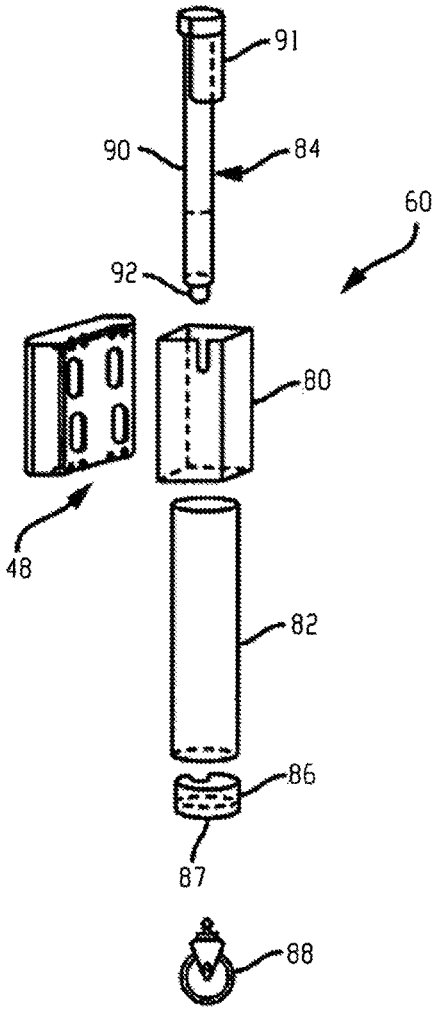
FIG. 6 is an exploded perspective view of an automatically adjustable support leg in accordance with the present disclosure.
Figure 7:
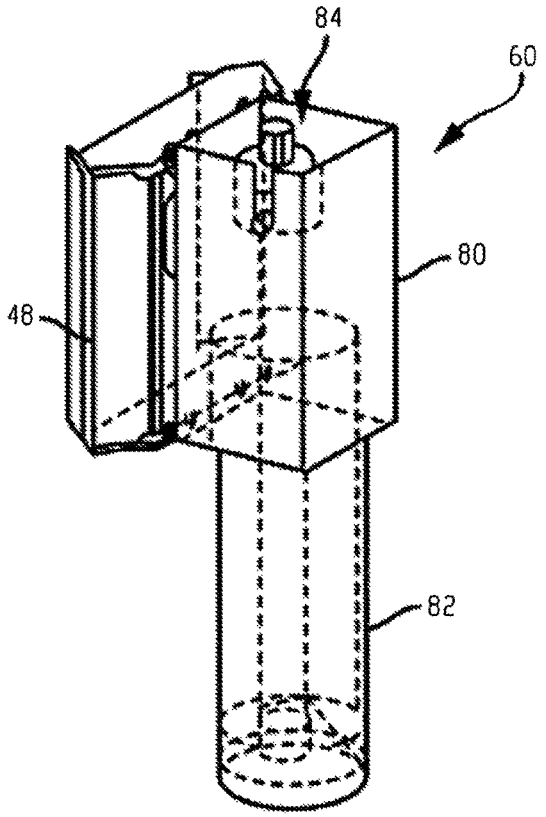
FIG. 7 is a perspective view of an automatically adjustable support leg in a retracted position in accordance with the present disclosure.
Figure 8:
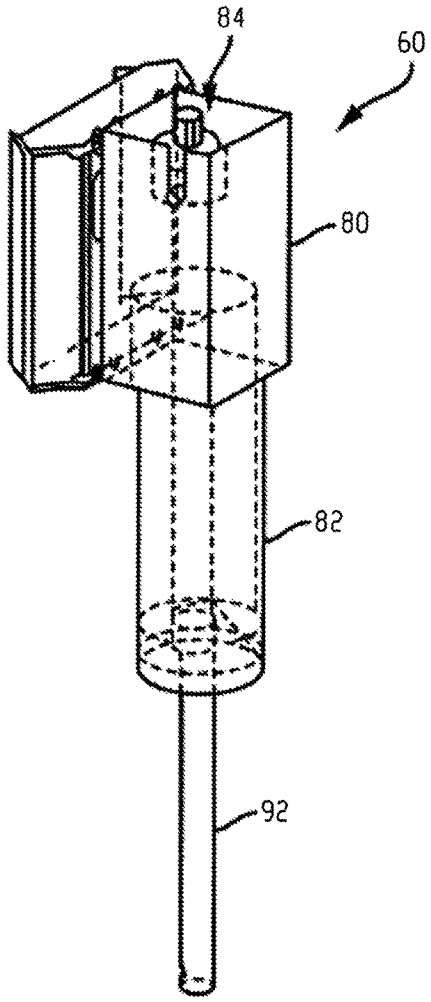
FIG. 8 is a perspective view of an automatically adjustable support leg in an extended position in accordance with the present disclosure.

Referring now to FIGS. 6-8, the support legs 60 can be configured to provide automatic adjustment. For automatic adjustment, the outer tubular member 80 is fastened to the corner bracket 48 as previously described. An inner tubular member 82 is fixedly attached at one end to the outer tubular member 80 and is non-movable relative to the outer tubular member 80. The inner tubular member 82 includes an endcap 86 at the other end. A linear actuator 84 is disposed within an interior region of and is fixedly attached to the outer tubular member 80. A portion of the linear actuator 84 extends into the interior region of the inner tubular member 82 and is coupled to the end cap 86, which includes an aperture 87.

The linear actuator can be a motorized mechanical linear force actuator and generally includes a cover tube 90 and motor 91 coupled thereto disposed within the outer tubular member 80. The linear actuator 84 further includes an extension tube 92 slideably engaged with the cover tube 82 and actuated by the motor 91. A caster (not shown) may be disposed at a distal end of the extension tube.

FIGS. 7 and 8 depict the adjustable leg in the retracted and extended positions, wherein the extent of the extended position can be varied to provide a desired clearance height for the foundation at that particular support leg. The extension tube 92 has a diameter equal to the aperture 87 in the end cap 86. As previously described, all or individual support legs can be connected to a controller (not shown) to adjust the clearance height of the foundation. For example, two of the support legs along the longitudinal length of the foundation 18 can be extended to provide an end user with better access to underneath the foundation such as may be desired when vacuuming underneath the foundation.

In an alternative embodiment, the foundation includes adjustable legs that are automatically adjustable utilizing one or two actuator assemblies to effect the adjustment. Utilizing a single actuator assembly as will be described in greater detail below can be used to simultaneously adjust each of the adjustable legs so as to uniformly raise and lower the foundation to a desired height. With regard to the use of the two actuator assembly, the foundation can be selectively raised or lowered at a respective side of the foundation, e.g., a side corresponding to a head end, a side corresponding to a foot end, or a selected one of the sides extending between the head end and foot end.

Figure 9:
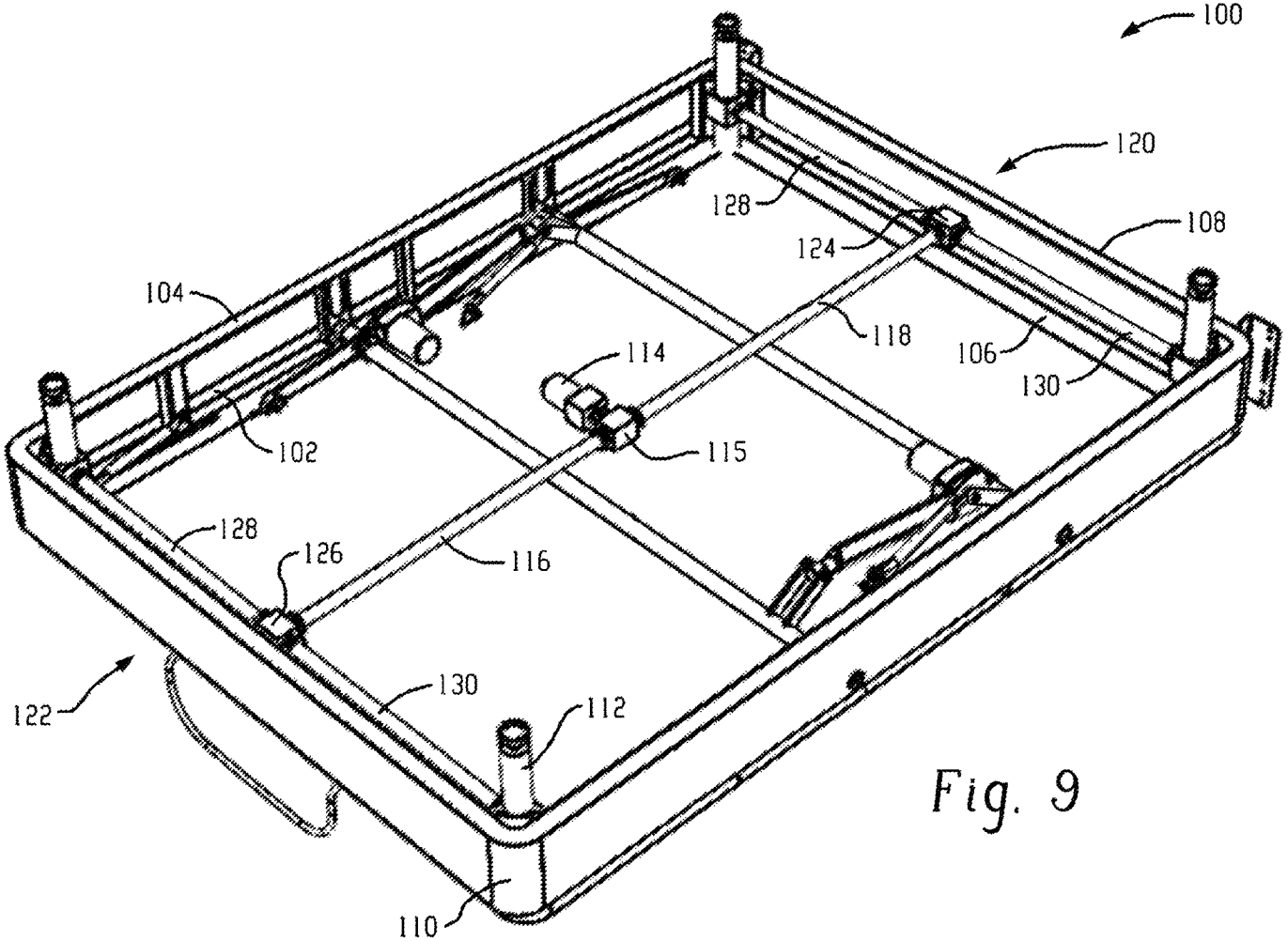
FIG. 9 is a bottom perspective view of a foundation frame including a single actuator assembly in accordance with the present disclosure.
Figure 10:
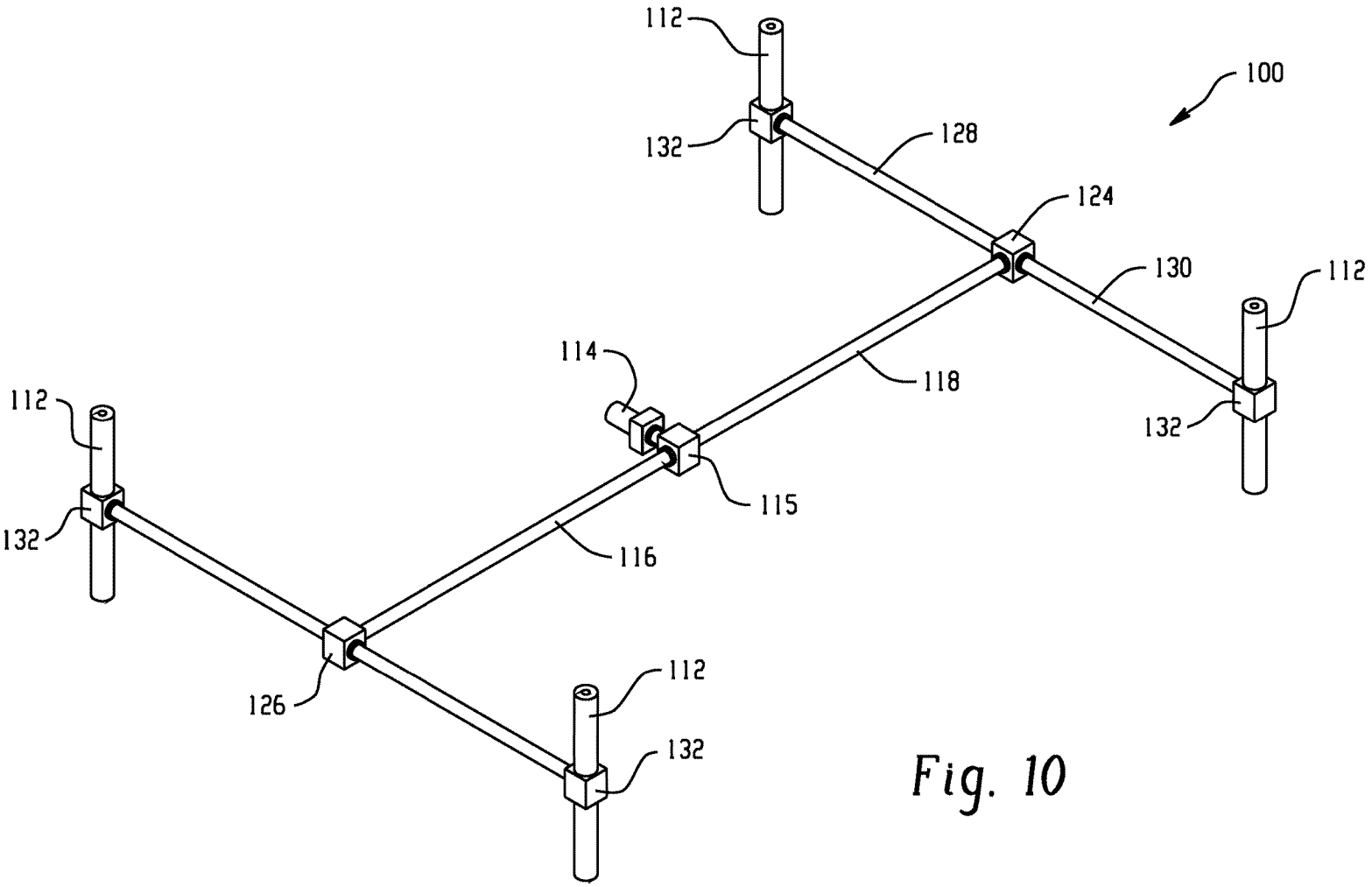
FIG. 10 is a perspective view of the single actuator assembly of FIG. 9 in accordance with the present disclosure.

Turning now to FIGS. 9 and 10, there is depicted a height adjustable foundation including single actuator assembly generally designated by reference numeral 100. As clearly shown in FIG. 9, the foundation 100 includes upper and lower side frame members 102, 104 respectively, and upper and lower transverse frame members 106, 108, respectively. The terms "upper" and "lower" generally refer to the position of the frame members when the foundation is positioned for use with its adjustable legs contacting the ground and the mattress provided on the foundation is elevated with respect to the ground. It should be apparent the present disclosure is not intended to be limited to the upper and lower frame members. In one or more embodiments, a single frame member can be utilized or greater than two members can be utilized. Respective ends of the upper and lower side frame members 102, 104 and the upper and lower transverse frame members 106, 108 are coupled to a corner bracket 110 to define the generally rectangular shape of the foundation frame 100. Adjustable support legs 112 are coupled to the corner brackets 110 and/or frame members 102, 104, 106, 108 at each corner of the foundation 100 for elevating the foundation 100 relative to ground.

The single actuator assembly for adjusting a height of the foundation in its entirety includes a single actuator 114, e.g., a rotary actuator, coupled to and configured to selective rotate drive shafts 116, 118 via differential 115. In this particular configuration, the drive shafts 116, 118 are medially located and extend between a head end 120 and a foot end 122 of the foundation 100 to drive differentials 124, 126 at each respective end 120, 122. Alternatively, the drive shafts can be medially located and extend from one side of the foundation to another side of the foundation. It should also be apparent to those skilled in the art that the drive shafts 116, 118 do not have to be medially located and can be offset. Likewise, the single actuator 114 does not have to be centrally located underneath the foundation 100 as shown but could be offset as well depending on the lengths of the drive shafts 116, 118 The offset drive shafts and/or single actuator may be beneficial for use with adjustable foundations so as to accommodate the various actuators and link arms utilized to effect inclination or declination of the different sections of the adjustable foundation, e.g., inclination or declination of the head end and/or the foot end as well as extension and shortening of the intermediate seat section, when indicated.

The drive differentials 124, 126 are coupled to respective drive shafts 128, 130, at each end 120, 122 of the foundation 100. Each drive shaft 128 or 130 is further coupled to a differential driven linear actuator 132 disposed within a leg housing as is generally discussed above albeit the linear actuator is no longer motorized but differential driven. In this manner, actuation of the single actuator 114 will extend or retract the adjustable legs 112 at each corner of the foundation. The single actuator 114 will rotate the drive shafts 116, 118, which in turn will rotate drive shafts 128, 130 that will engage the differential driven linear actuators 132 within the adjustable legs 112 to extend or retract the adjustable legs. In this manner, the height of the foundation 100 can be raised or lowered by actuating the actuator 114 to simultaneously raise or lower each leg 112.

Figure 11:
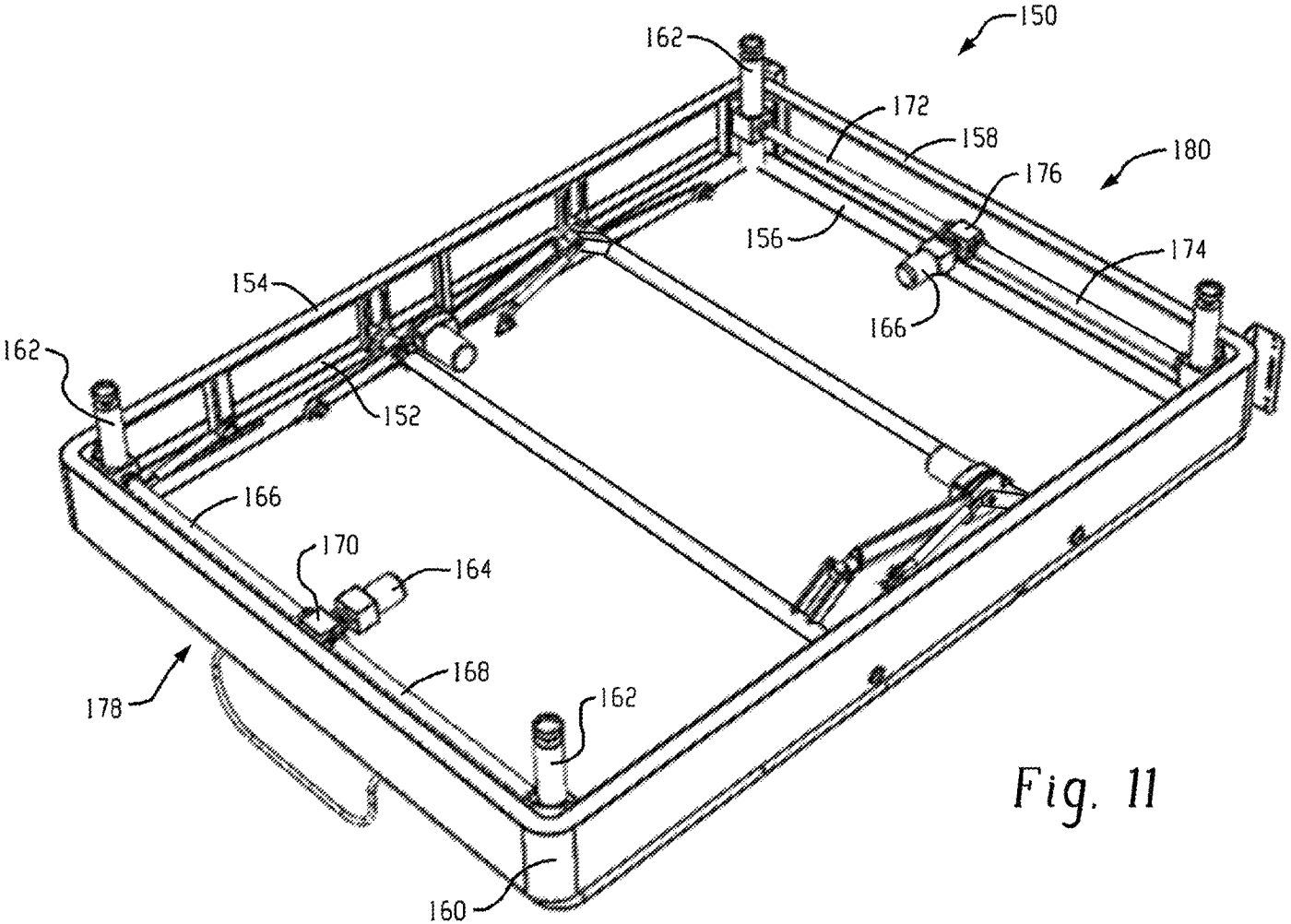
FIG. 11 is a bottom perspective view of a foundation frame including two actuator assemblies in accordance with the present disclosure.
Figure 12:
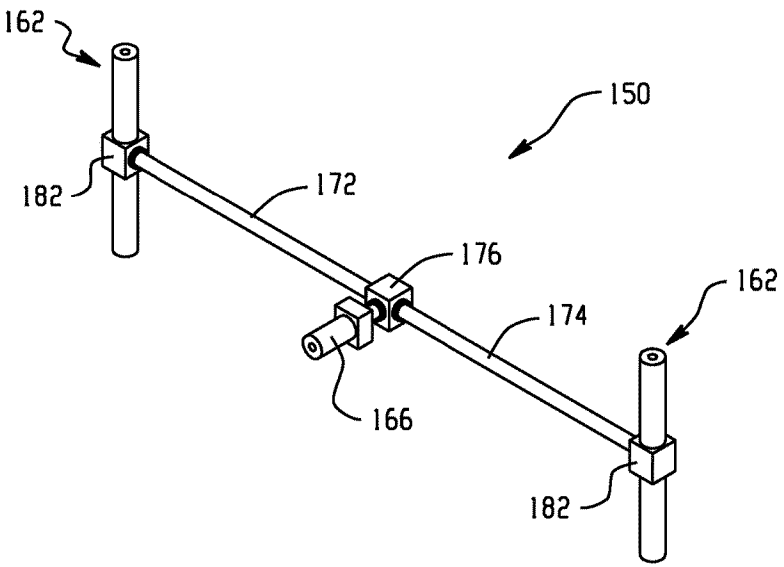
FIG. 12 is a perspective view of the two actuator assemblies shown of FIG. 11 in accordance with the present disclosure.
Figure 12:
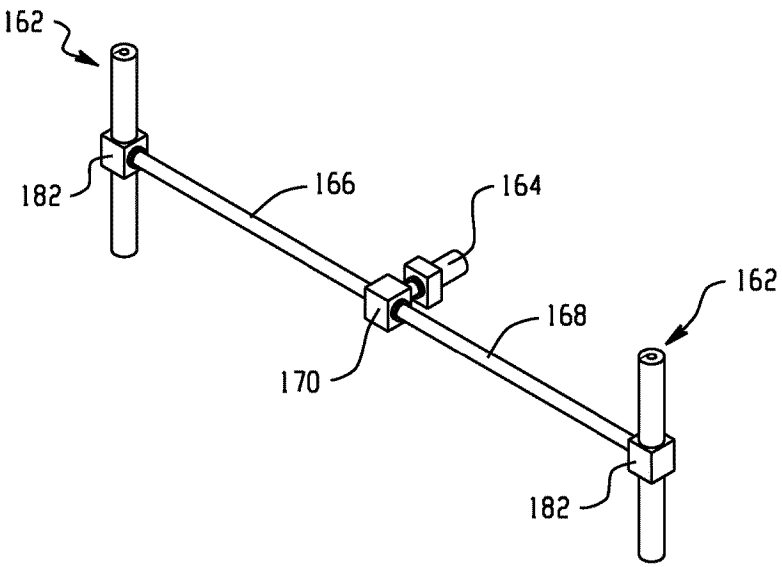
Figure 13:
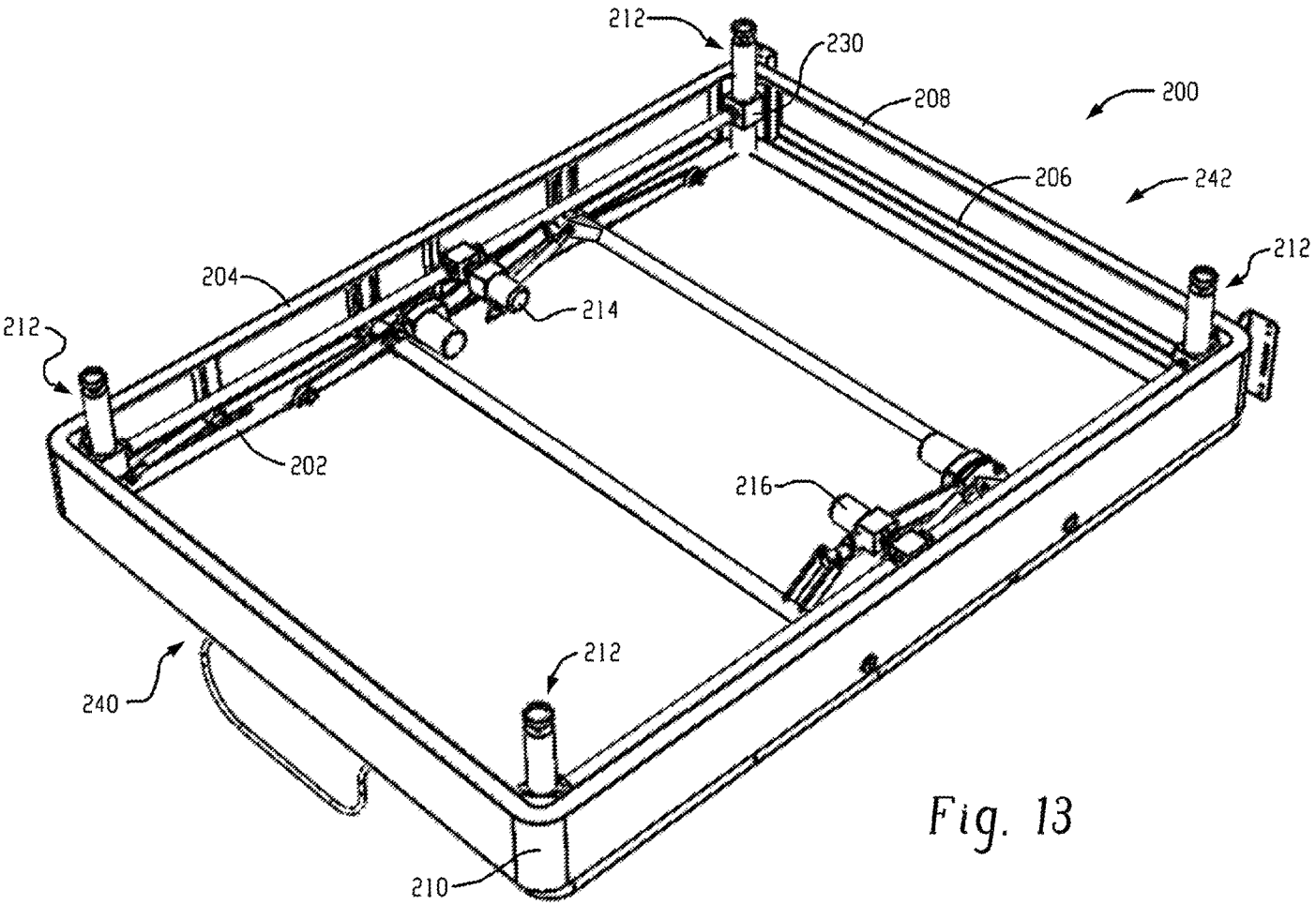
FIG. 13 is a bottom perspective view of a foundation frame including two actuator assemblies in accordance with another embodiment of the present disclosure.
Figure 14:
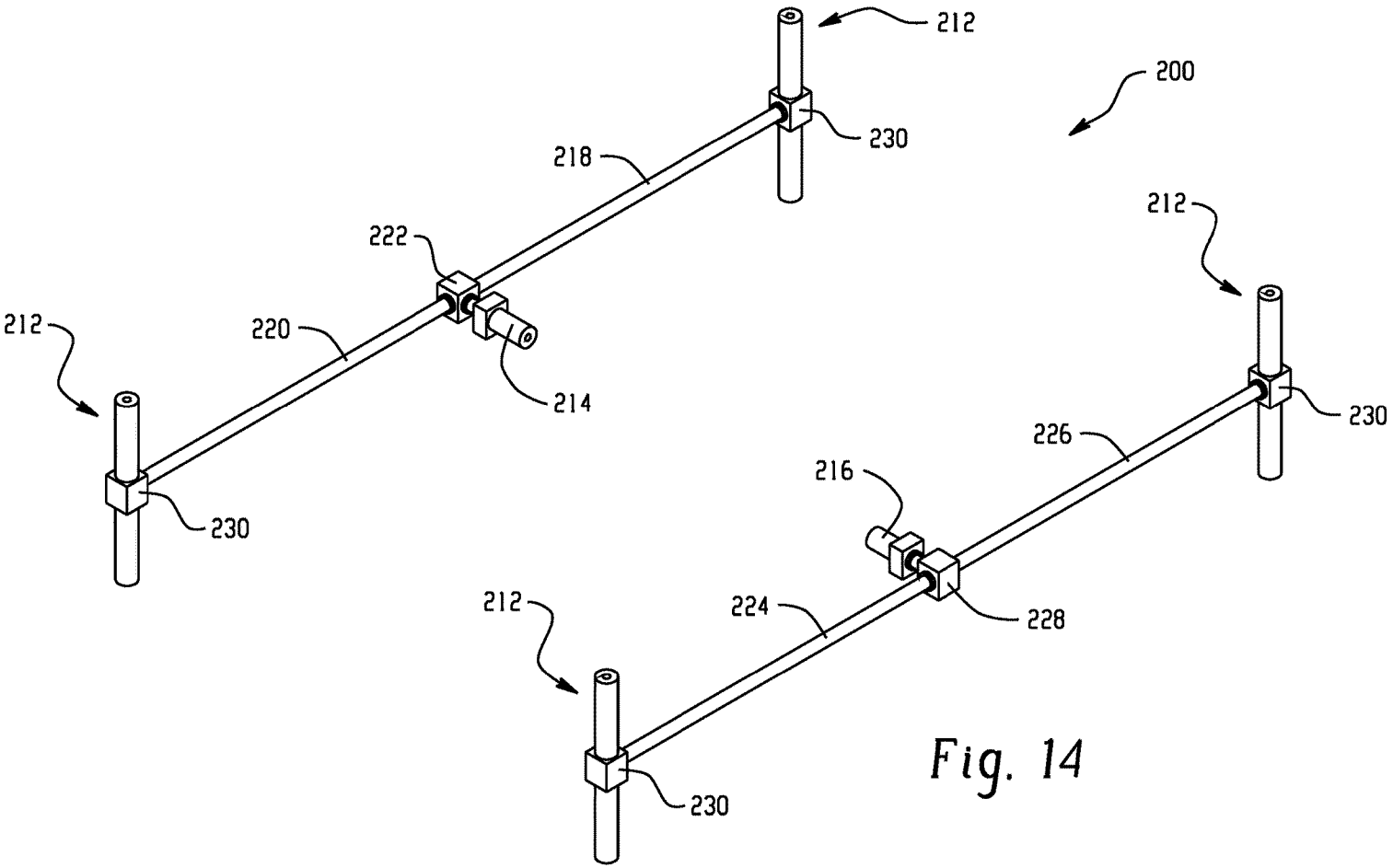
FIG. 14 is a perspective view of the two actuator assemblies shown of FIG. 13 in accordance with the present disclosure.

Referring now to FIGS. 11 and 12, there is depicted a height adjustable foundation including two actuator assemblies generally designated by reference numeral 150. The two actuator assemblies are configured to raise or lower adjacent pairs of the adjustable legs. In this manner, the head end could be at a greater height than the foot end or vice versa or one side could be at a greater height than the other side depending on the configuration of the two actuator assemblies and selective adjustment of the adjacent pair of adjustable legs.

Similar to the previous foundation shown in FIG. 9, foundation 150 includes upper and lower side frame members 152, 154 respectively, and upper and lower transverse frame members 156, 158, respectively. Respective ends of the upper and lower side frame members 152, 154 and the upper and lower transverse frame members 156, 158 are coupled to a corner bracket 160 to define the generally rectangular shape of the foundation frame 150. Adjustable support legs 162 are coupled to the corner brackets 160 at each corner of the foundation 100 for elevating the foundation 150 relative to ground.

The foundation 150 further includes two actuators 164, 166, e.g., rotary actuators, independently coupled to and configured to selective rotate drive shafts 166, 168 via differential 170 and drive shafts 172, 174 via differential 176. In this particular configuration, the drive shafts 166, 168 and 170, 172 are located parallel at the head end 178 and foot end 180, respectively, and transversely extend from one side of the foundation 150 another side of the foundation 150. It should be apparent to those skilled in the art that the actuator 164, 166 do not have to be medially located at the respective foundation end as shown but could be offset depending on the lengths of the drive shafts 166, 168 and 172, 174. As previously noted, the offset actuators may be beneficial for use with adjustable foundations so as to accommodate location of the various actuators and link arms utilized to effect inclination or declination of the different sections of the adjustable foundation, e.g., inclination or declination of the head end and/or the foot end as well as extension and shortening of the intermediate seat section, when indicated.

As noted above, the two actuators 164, 166, are independently coupled to and configured to selective rotate drive shafts 166, 168 via differential 170 and drive shafts 172, 174 via differential 176. Each drive shaft 166, 168, 172, and 174 is further coupled to a differential driven linear actuator 182 disposed within a housing defined by the leg 162. In this manner, actuation of a selected one or both of the actuators 164, 166 will extend or retract the adjustable legs 162 at each end of the foundation. As such, the foundation as a whole can be raised or lowered by actuating both actuators 164, 166 or the foundation can be positioned into a positive or reverse Trendelenburg position. In the positive Trendelenbrug position, the foot end 178 can be raised or the head end 180 could be lowered or a combination differthereof such that the feet are higher than the head, typically by 15 to 30 degrees higher. In the reverse Trendelenbrug position, the head end 180 can be raised or the foot end 178 lowered or a combination thereof such that the head is higher than the head.

Actuator 164 will rotate the drive shafts 166, 168, which will engage the differentials 182 within the adjustable legs 162 to extend or retract the adjustable legs at the foot end. In this manner, the height of the foundation 150 with respect to the foot end 178 can be raised or lowered. Likewise, actuator 166 will rotate the drive shafts 172, 174, which will engage the differential driven linear actuators 182 within the adjustable legs 162 to extend or retract the adjustable legs at the head end. In this manner, the height of the foundation 150 with respect to the head end 178 can be raised or lowered. As noted above, both actuators 164, 166 can be synchronized to raise or lower the foundation 150 in its entirety or a selective one of the actuators many be actuated to selective raise or lower a selected end of the foundation 150 whereas the other end remains stationary.

Figure 15:
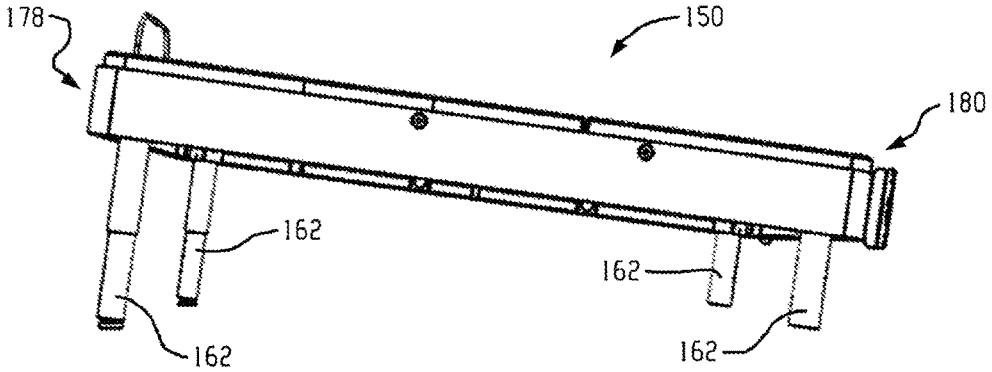
FIG. 15 is a side perspective view of a foundation frame in accordance with the present disclosure depicting the foot end raised relative to the head end of the foundation frame in accordance with the present disclosure.

FIG. 15 provides a side perspective view of the foundation 150, wherein the adjustable legs 162 at the foot end 178 are raised relative to the adjustable legs 162 at the head end 180. In this embodiment, actuator 164 rotates drive shafts 166, 168 via drive differential 170. Rotation of the drive shafts 166, 168 engages differential driven linear actuators 182 at the foot end 178 to raise the adjustable legs 162 relative to the head end 180 resulting in a positive Trendelenburg position, wherein a prone end user's legs are raised relative to the head.

In one or more embodiments, the dual actuator foundation is configured to selectively raise and lower the adjustable legs corresponding to a side of the foundation frame so as to permit ease in ingress and egress as may be desirable to some end users. In this embodiment, the foundation frame 200 includes upper and lower side frame members 202, 204 respectively, and upper and lower transverse frame members 206, 208, respectively. Respective ends of the upper and lower side frame members 202, 204 and the upper and lower transverse frame members 206, 208 are coupled to a corner bracket 210 to define the generally rectangular shape of the foundation frame 200. Adjustable support legs 212 are coupled to the corner brackets 210 at each corner of the foundation 200 for elevating the foundation 200 or side portions thereof relative to ground.

The foundation 200 further includes two actuators 214, 216, e.g., rotary actuators, independently coupled to and configured to selective rotate drive shafts 218, 220 via differential 222 and drive shafts 224, 226 via differential 228. In this particular configuration, the drive shafts 218, 220 and 224, 226 are located parallel to the sides of the foundation, i.e., the longitudinal length from a head end to a foot end of the foundation 200. It should be apparent to those skilled in the art that the actuators 214, 216 do not have to be medially located along the foundation side as shown but could be offset depending on the lengths of the drive shafts 218, 220 and 224, 226. As previously noted, the offset actuators may be beneficial for use with adjustable foundations so as to accommodate location of the various actuators and link arms utilized to effect inclination or declination of the different sections of the adjustable foundation, e.g., inclination or declination of the head end and/or the foot end as well as extension and shortening of the intermediate seat section, when indicated.

As noted above, the two actuators 214, 216, are independently coupled to and configured to selective rotate drive shafts 218, 220 via drive differential 222 and drive shafts 224, 226 via drive differential 228. Each drive shaft 218, 220, 224, and 226 is further coupled to a differential driven linear actuator 230 disposed within a housing defined by the leg 212. In this manner, actuation of a selected one or both of the actuators 214, 216 will extend or retract the adjustable legs 212 along a selected side or both sides of the foundation 200. As such, the foundation 200 as a whole can be raised or lowered by actuating both actuators 164, 166 or the foundation 200 can be positioned to ease ingress or egress from the mattress.

Actuator 214 will rotate the drive shafts 218, 220 via differential 222, which will engage the differentials 230 within the adjustable legs 162122 to extend or retract the adjustable legs along a particular side of the foundation 200. In this manner, the height of the foundation 200 with respect to the particular side can be raised or lowered. Likewise, actuator 216 will rotate the drive shafts 224, 226, via differential 228 which will engage the differential driven linear actuators 230 within the adjustable legs 1212 62 to extend or retract the adjustable legs at the other side of the foundation frame 200. In this manner, the height of the foundation 150 with respect to the other side can be raised or lowered. As noted above, both actuators 214, 216 can be synchronized to raise or lower the foundation 200 in its entirety or a selective one of the actuators 214 or 216 may be actuated to selectively raise or lower one side of the foundation 200 whereas the other side remains stationary.

Figure 16:
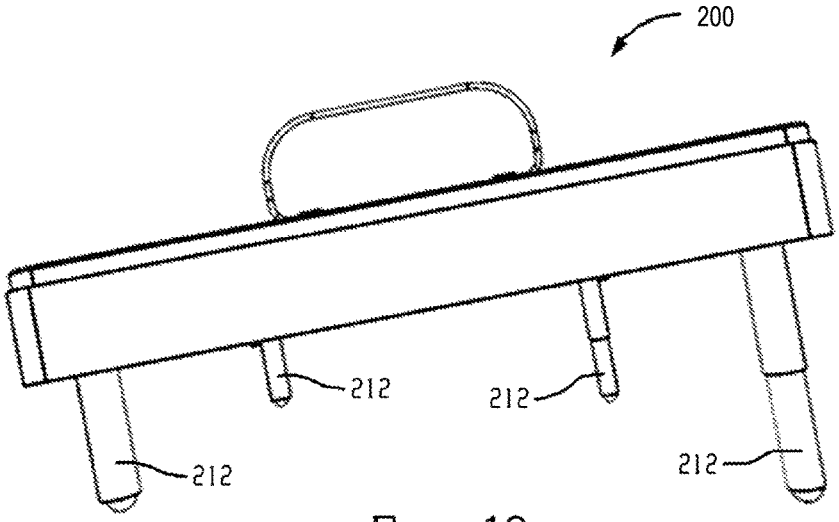
FIG. 16 is an end on perspective view of a foundation frame in accordance with the present disclosure depicting one side raised relative to another side of the foundation frame in accordance with the present disclosure.

FIG. 16 provides a perspective view of the foundation 200 from the foot end 240 as opposed to the head end 242, wherein the adjustable legs 212 on one side are raised relative to the adjustable legs 212 on the other side. In this embodiment, actuator 214 rotates drive shafts 218, 220 via drive differential 222. Rotation of the drive shafts 218, 220 engages differential driven linear actuators 230 within the adjustable legs 212 to raise the adjustable legs 212 along one side of the foundation relative to the other side of the foundation resulting in a mattress tilt when viewed from the foot end. In some embodiments, instead of raising the adjustable legs along one side as described above, the adjustable legs can be selectively lowered along one side to lower the overall distance to ground at that particular side, which can be make it easier for egress or ingress to a mattress disposed on the foundation.

In one or more embodiments, a process for ingress/egress from a mattress assembly including the adjustable support legs can include synchronization of two or more of the adjustable support legs so as to lower a height of the mattress. In this manner, ingress as well as egress can be easily facilitated. For example, the adjustable legs 60 along a longitudinal length of the foundation located at corners of the head section and the foot section, e.g., right hand side or left hand side or both, can be lowered to facilitate facile ingress and egress to/from the mattress. Once the user is situated on the mattress, the adjustable legs can be raised to provide the mattress in a horizontal position relative to ground or can be maintained at that position until such time the user decides to access the mattress.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A mattress assembly, comprising:

a foundation frame comprising side frame members and transverse frame members attached at respective ends by a corner bracket to define a generally rectangular shape;

a deck supported by the foundation frame, the deck including a head and back section, an intermediate seat section, and a leg and foot section;

adjustable support legs coupled to each one of the corner brackets, wherein each of the adjustable support legs comprises an outer tubular member fastened to an interior facing portion of the corner bracket and a differential driven linear actuator fixedly attached to the outer tubular member and disposed within an interior region thereof and comprising an extendible portion configured to retract or extend through a lower end of the interior region so as to change an elevation of the foundation frame relative to ground upon actuation thereof; and a single rotary actuator assembly mechanically engaged with the differential driven linear actuators in each one of the adjustable support legs to simultaneously and selectively extend or retract the extendible portion, wherein the single rotary actuator assembly comprises a single rotary actuator coupled to a first drive differential for selectively rotating linearly arranged first drive shafts having one end coupled to the first drive differential and another end coupled to second and third drive differentials, wherein the second and third drive differentials are configured to rotate linearly arranged second drive shafts that are orthogonal to the linearly arranged first drive shafts having one end coupled to the second or the third drive differential and another end coupled to fourth drive differentials disposed within the adjacent pair of adjustable legs and in operative communication with the differential driven linear actuators to effect simultaneous extension or retraction of the extendible portions upon actuation thereof.

2. The mattress assembly of claim 1, wherein the linearly arranged first drive shafts extend along a length of the foundation frame and the linearly arranged second drive shafts extend along a width of the foundation frame.

3. The mattress assembly of claim 1, wherein the linearly arranged first drive shafts extend along a width of the foundation frame and the linearly arranged second drive shafts extend along a length of the foundation frame.

4. The mattress assembly of claim 1, wherein the linearly arranged first drive shafts are medially located within the foundation frame and the linearly arranged second drive shafts are located at a head end and foot end or along each side of the foundation frame.

5. The mattress assembly of claim 1, wherein the extendible portion further comprises a caster, a rotatable ball, or a swivel wheel attached to a free end of the extendible portion.

6. The mattress assembly of claim 1, further comprising a foam block coupled to an exterior facing portion of the corner bracket, wherein the foam block has an arcuate shaped exterior portion projecting from the corner bracket.

7. The mattress assembly of claim 1, further comprising a foam block coupled to an exterior facing portion of the corner bracket, wherein the foam block has a first exterior facing side and a second exterior facing side perpendicular to the first exterior facing side.

8. The mattress assembly of claim 1, wherein the deck is non-articulating.

9. The mattress assembly of claim 1, wherein the deck is articulating.

10. A process for adjusting a height of a mattress assembly, the process comprising:

providing a mattress on a foundation frame comprising side frame members and transverse frame members attached at respective ends by a corner bracket to define a generally rectangular shape; a deck supported by the foundation frame, the deck including a head and back section, an intermediate seat section, and a leg and foot section; and adjustable support legs coupled to each one of the corner brackets and configured to selectively change an elevation of the foundation frame relative to ground, wherein each of the adjustable support legs comprises an outer tubular member fastened to an interior facing portion of the corner bracket and a differential driven linear actuator fixedly attached to the outer tubular member and disposed within an interior region thereof and comprising an extendible portion configured to retract and extend through a lower end of the interior region to change the elevation of the foundation frame relative to ground upon actuation thereof; and lowering or raising an adjacent pair or all of the adjustable support legs to adjust the height of the mattress relative to ground.

11. The process of claim 10, wherein lowering or raising a selected pair of the adjustable support legs results in the height of a head end of the foundation frame to be lower than the foot end.

12. The process of claim 10, wherein lowering or raising a selected pair of the adjustable support legs results in the height of a foot end of the foundation frame to be lower than the head end.

13. The process of claim 10, wherein lowering or raising a selected pair of the adjustable support legs results in the height of one side of the foundation frame to be lower than the other side of the foundation.

* * * * *